US005616042A

United States Patent [19]

Raby, Sr. et al.

[11] Patent Number: 5,616,042

[45] Date of Patent: Apr. 1, 1997

[54] ADAPTER FOR CONVERTING FLUORESCENT LIGHT FIXTURES

[76] Inventors: Frederick R. Raby, Sr.; Bruce R. Raby, both of 3030 N. Middle Side Road, Amherstburg, Ontario, Canada, N9V 2Y9

[21] Appl. No.: 496,054

[22] Filed: Jun. 28, 1995

[51] Int. Cl.[6] ..... H01R 33/02

[52] U.S. Cl. ..... 439/226; 439/240

[58] Field of Search ..... 439/225, 226, 439/235, 236, 239, 240, 241, 502

[56] References Cited

U.S. PATENT DOCUMENTS 4,928,209 5/1990 Rodin ..... 439/226

5,368,495 11/1994 Raby, Sr. et al. ..... 439/226

*Primary Examiner*—Neil Abrams
*Assistant Examiner*—Yong Kim
*Attorney, Agent, or Firm*—John R. Benefiel

[57] ABSTRACT

An adapter is disclosed for connecting a pair of wire leads to the pin contacts of a fluorescent light fixture socket in which a central pin is located between two pins each connected to a wire lead, the central pin engaging the socket to lock the adapter to the socket with the pins rotated into the socket. A wire lead cap is also provided for an auxiliary socket mounting the light tube in a relocated position, the cap having pins received in the wire lead socket terminals, the cap enclosing the wire leads to avoid a shock hazard.

21 Claims, 4 Drawing Sheets

ADAPTER FOR CONVERTING FLUORESCENT LIGHT FIXTURES

BACKGROUND OF THE INVENTION

This invention relates to converting existing fluorescent fixtures by reducing the number of fluorescent light tubes in order to reduce energy consumption. In such conversion, a single tube replaces two original tubes and is relocated to a new location in the fixture in order to avoid the appearance of shadows which would otherwise appear if a tube was simply removed.

U.S. Pat. No. 5,368,495 issued to the present inventors on Nov. 29, 1994 for a "Method and Adapter for Relocating a Fluorescent Tube in a Fixture" describes an adapter which plugs into existing sockets in order to provide an electrical connection to an auxiliary socket at the new location for the single replacement tube.

Copending applications U.S. Ser. No. 08/131,718 filed on Oct. 5, 1993 and U.S. Ser. No. 08/310,274 filed on Sep. 21, 1994 also describe and claim related devices.

That patent describes contact pins which are grooved in order to provide a retention of the adapter in the socket. Clips are also provided encircling the socket and the adapter.

An object of the present invention is to further improve the retention force for such an adapter when installed in an existing tube socket over that generated by grooving of the pins.

Another problem encountered with auxiliary sockets is encountered in connecting the wires from the adapter to the socket, since the wires will be exposed, unless molded into the auxiliary socket. Suitable existing sockets have socket contacts receiving stripped wire ends to make an electrical connection. Relatively heavy gauge, high temperature wire is required by safety authorities, which cannot be fully inserted into the socket contact openings in the tip of the auxiliary socket, such that bare wire would be exposed. Exposure of bare wire is not considered acceptable.

Another requirement is to insure proper positioning of the auxiliary socket to be sufficient to provide necessary clearance for installation of large diameter replacement tubes.

It is a further object of the invention to provide a cap for auxiliary sockets which completely encloses the wire leads to avoid shock hazards and to provide a correct spacing of the auxiliary socket and to otherwise facilitate installation in a fixture housing.

SUMMARY OF THE INVENTION

These and other objects of the invention are achieved by a three pin male adapter, which include a non conducting central locking pin located between the two conductive contact pins. The central locking pin is received between projecting insulator pin guides molded into the auxiliary sockets. In a first embodiment, the locking pin is shaped so that as two diametrically aligned contact pins are rotated into engagement with the socket contacts, the locking pin is wedged into tight engagement with the opposing surfaces of the pin guides to securely hold the adapter to the auxiliary socket.

In a second embodiment, the central pin is spring mounted and forced into frictional engagement with a central contour of a V shape as the contact pins are rotated into their seats.

The central pin preferably may be axially slotted to allow compression thereof and thereby limit the wedging force exerted as the adapter is rotated to the installed position.

A resilient locking tab may also be provided which snaps into the slot in the socket as the adapter is rotated to its installed position, augmenting the locking effect of the wedging of the central pin.

In a third embodiment, the adapter is attached to the auxiliary socket by a threaded fastener comprising the locking pin, passing through a centrally located bore and received between the pin guides where the threads cause the fastener to be wedged between the pin guides.

According to another aspect of the invention, a cap for the auxiliary socket is designed to be plugged into the top of the auxiliary socket, the cap serving to enclose a pair of wire leads inserted into the socket, and to act as a spacer and to otherwise facilitate the installation of the socket in a light fixture housing.

In a first embodiment, the cap acts as a shield for stripped wire leads which are inserted into contact openings formed in a molded top of the auxiliary socket.

In a second embodiment, the cap replaces the auxiliary socket top, and has the wire leads molded into the cap body and connected to contact pins which are inserted into the contacts of the auxiliary socket.

The leads may be directly connected to the wire leads for a replacement ballast, to dispense with the need for the male adapter.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
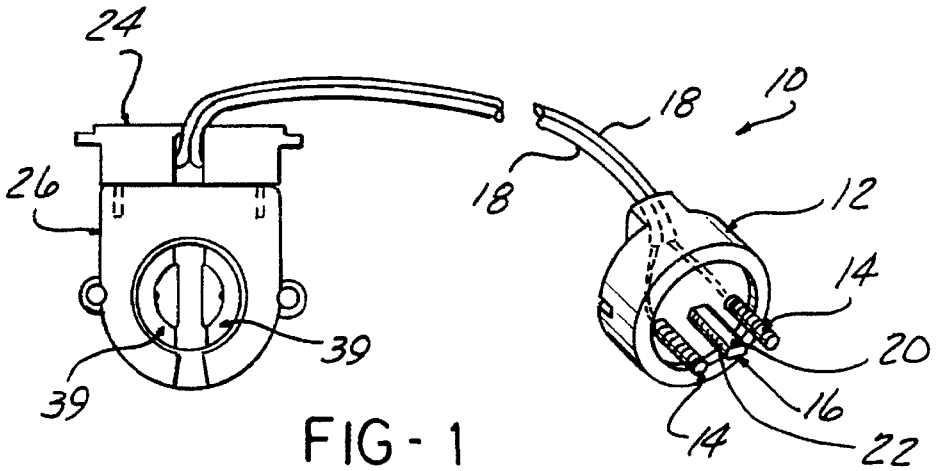
FIG. 1 is a perspective view of an adapter according to the present invention and of a connected cap shown installed on an auxiliary socket.
Figure 1A:
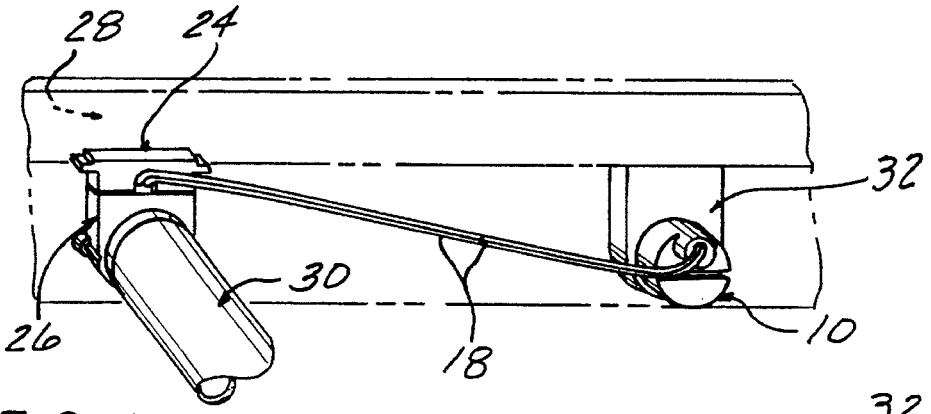
FIG. 1A is a perspective view of the adapter and cap shown in FIG. 1 installed in a light fixture, the outline of which is shown in phantom together with a fragmentary portion of a light tube installed in an auxiliary socket.

Referring to FIG. 1, an adapter 10 according to the present invention is shown. A first embodiment of the adapter 10 according to the present invention includes a generally cylindrical adapter body 12, which has two contact pins 14 extending axially from one face of the body 12, and a central locking pin 16 which is oblong in transverse section. Each of the contact pins 14 and the central pin 16 are embedded in the adapter body 12 which may advantageously be constructed of a molded plastic.

The contact pins 14 are made of an electrically conductive material such as copper, brass, etc, and are electrically connected to a conductor of a respective one of a pair of wire leads 18, which are molded into the adapter body 12. The contact pins 14 are aligned with each other on either side of the center line of the adapter body 12 on which is located the central locking pin 16.

Locking pin 16 may be molded as an integral part of the molded plastic adapter body 12. Each of the pair of contact pins 14, and the central locking pin 16 preferably have their diameters grooved or threaded, in order to improve retention of the adapter in an existing socket as described in U.S. Pat. No. 5,368,495, described above.

As noted, the locking pin 16 has an elongated or oblong shape in transverse section, the elongation produced as by having flattened sides 20, the rounded outer sides 22 provided with the grooved contour. The rounded outer sides 22 engage the surface of the pin guides of the socket, as will be described hereinafter.

The wire leads 18 extend to an auxiliary socket cap 24 which is inserted in an the top of an auxiliary socket 26, which will be described hereinafter in further detail.

The auxiliary socket 26 and cap 24 are installed together into the light fixture housing 28, at a location whereat a single fluorescent tube 30 is to be installed in an offset location from an original fixture socket 32, with which the light fixture 28 was originally equipped.

Figure 2A:
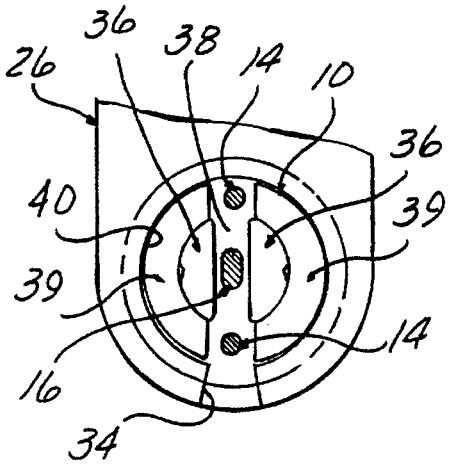
FIG. 2A is an end sectional view of the pins included in the adapter according to the present invention in an initial position when received in an auxiliary socket.
Figure 2B:
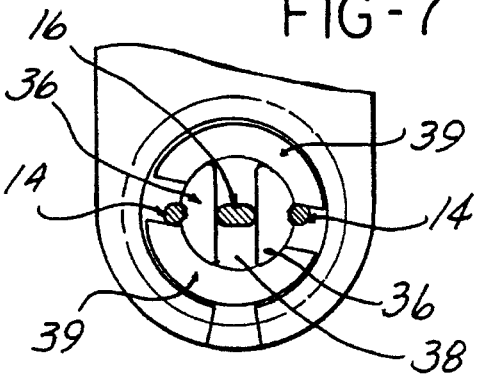
FIG. 2B is a sectional view of the adapter pins, shown rotated to the fully installed locked position in an auxiliary socket.

FIGS. 2A and 2B show the contact pins 14 after insertion through the entrance slot 34, to be aligned on either side of the molded non-conductive pin guides 36, which are spaced apart with an intermediate slot 38 therebetween. In this position the central pin 16 is centered in the slot 38 with the long dimension thereof extending in alignment with the contact pins 14. The narrow width dimension of the locking pin 16 is such as to freely pass into the slot 38 between the pin guides 36.

The auxiliary socket 26 is preferably equipped with partially annular nonconductive anti-shock sliding pieces 39 which are received in the space between the outside of the pin guides 36 and the housing wall 40 of the auxiliary socket 26. These anti-shock pieces 39 are known in the art, and cover the contacts of the auxiliary socket 26, such that inadvertent contact with the finger of an installer will not result in an electrical shock being given to the installer.

As the adapter 10 is rotated into an installed position, the contact pins 14 are rotated to a horizontal relationship as shown in FIG. 2B pushing the anti-shock sliding pieces 39 ahead. The locking pin 16 is rotated to orient its larger dimension to extend transversely to the slot 38 between the pin guides 36.

The dimension of the thicker dimension of the locking pin 16 is selected such that a wedging action occurs as the greater dimensioned thickness rotates transversely to the slot 38 to become securely wedged therein. The increased friction established by this wedging action greatly improves the retention force, preventing dislodgement of the adapter from the original socket 32. The non uniform sectional shape of the locking pin 16 can take a variety of forms, i.e., rectangular, triangular, elliptical, etc. as long as this wedging action occurs.

Figure 3A:
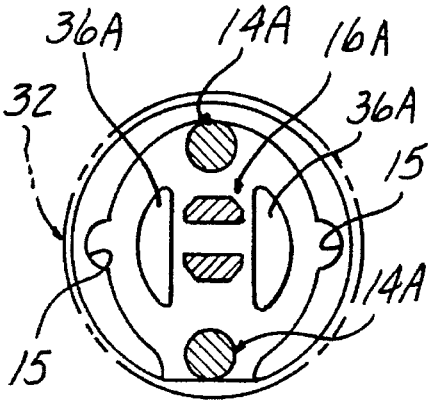
FIG. 3A is an enlarged sectional view taken through the pins of the adapter shown in FIG. 3, with the pins inserted into a socket.
Figure 3B:
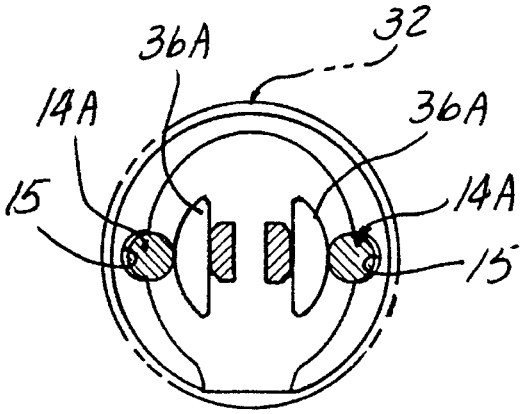
FIG. 3B is a sectional view of the pins of the adapter of FIG. 3A, shown rotated to the locked position.
Figure 3:
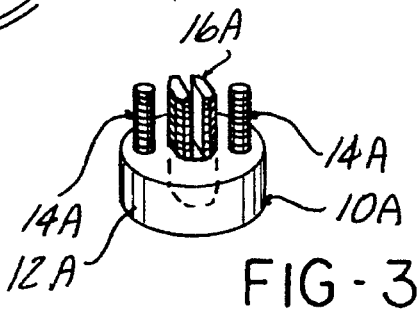
FIG. 3 is a perspective view of an adapter having a preferred split version of the central locking pin.

As shown in FIG. 3, the central locking pin 16A of an alternate adapter 10A is configured to be axially split in the portion projecting from the adapter body 12A so as to reduce the wedging pressure when the central locking pin 16A is rotated to bring the contact pins 14A to be seated on the socket contacts 15. The shock slides are not shown in these views. Each half of the pin 16A is shaped as one half of a hexagon, so that a flat surface moves against the surface of the respective engaged pin guide 36A, this arrangement tending to further secure the adapter 10A in its installed position. The central pin 16A is wider in the orientation shown in FIG. 3B, so that the halves of the pin 16A tend to be squeezed together when wedged between the inside surface of the pin guides 36A to generate the wedging locking force. Since the pin halves can be compressed together, this prevents excessive forces tending to crack the socket 32.

Figure 4A:
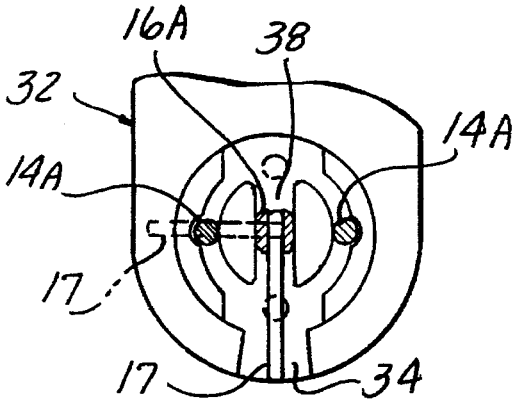
FIG. 4A is a view of a section through the adapter pins of the adapter shown in FIG. 4 depicting in phantom the engagement of the latching tab.
Figure 4:
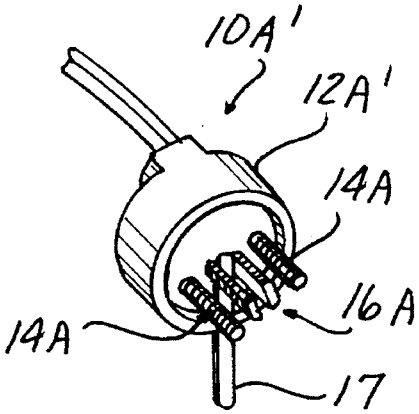
FIG. 4 is a perspective view of an adapter having a latching tab molded into the adapter body.

FIGS. 4 and 4A show the addition of a latching tab 17 integrally molded into the adapter body 12A' of an adapter 10A' according to another variation. The latching tab 17 projects outwardly between the halves of the split central pin 16A, extending at right angles to a line drawn between the contact pins 14A.

The latching tab 17 is flattened against the face of the socket 32 when the adapter 10A' is first inserted in the socket 32. As the contact pins 16A are rotated to be installed, the latching tab springs out into the slot 38 and the entrance 34, restraining the adapter 10A' from rotating completely out of its installed position.

Figure 5:
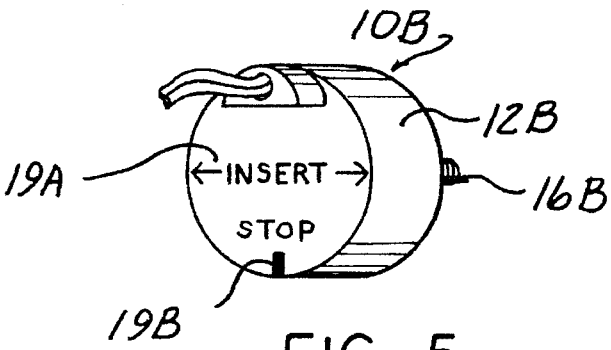
FIG. 5 is a perspective view of an adapter having alignment markings to aid in installation in a socket.

FIG. 5 shows an adapter 10B is which external markings 19 are provided on the adapter body to ease the task of installing the adapter 10B, by appropriately aligning the marks 19A with the contact pins 16B.

Alternatively, the adapter body can be constructed of clear plastic to allow the contact pins 16 to be aligned with the slot 38.

Figure 6:
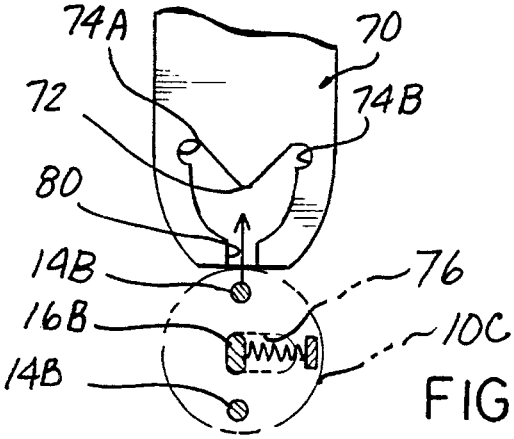
FIG. 6 is a sectional view through the pins of an adapter according to a second embodiment of the present invention in position adjacent an auxiliary socket for installation of the adapter in an existing light fixture of an altered configuration.
Figure 6A:
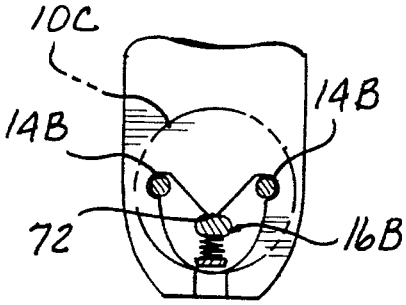
FIG. 6A is the section view of the pins of the adapter shown in FIG. 6, with the adapter rotated in the auxiliary socket to be installed therein.

FIGS. 6 and 6A show a different configuration of the adapter 10C, usable with the V style of socket 70 shown therein, in which a central divider constituted by, a V guide surface 72 is provided spacing pin contact seats 74 on either side. The pin contacts 14B are again aligned at diametrically opposite locations, with an oblong shaped pin 16B extending located therebetween. The pin 16B is movably mounted in a slot 76, and spring urged by spring 78 to the center position as shown in FIG. 6.

Upon entry of the contact pins 14B, through a central slot 80 in the original socket 70, the adapter 10C is rotated to bring the first pin in one of the socket pin recess 74, and swung around to bring the other pin socket in the opposite seat 74B. By this action the central pin 16B is spring biased into frictional contact with the peak of the guide 72, to enhance the retention force available to secure the adapter 10C in the socket 70. A slight arced surfaces on the opposite longer sides of the central pin 16B may be provided to increase the surface contact with the peak of the guide 72 as indicated in FIG. 6A.

Figure 7A:
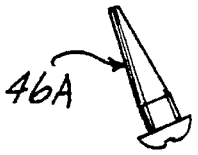
FIG. 7A is an enlarged perspective view of a tapered side locking pin.
Figure 7:
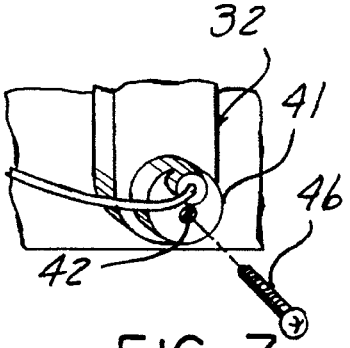
FIG. 7 is a fragmentary exploded view of an adapter according to a second embodiment of the present invention shown installed in an auxiliary socket.

An alternative to a central pin is shown in FIG. 7, in which a socket 41 may be provided with a central opening 42, aligned with slot 38 in the original socket 36 such as to receive a retention screw 46, which will engage the sides of pin guides 36 as the screw 46 is advanced to positively retain the adapter 10A in position on the original socket 37. The screw 46 may also be replaced with an axially tapered pin 46A shown in FIG. 7A which simply wedges between the pin guides 36.

Figure 8:
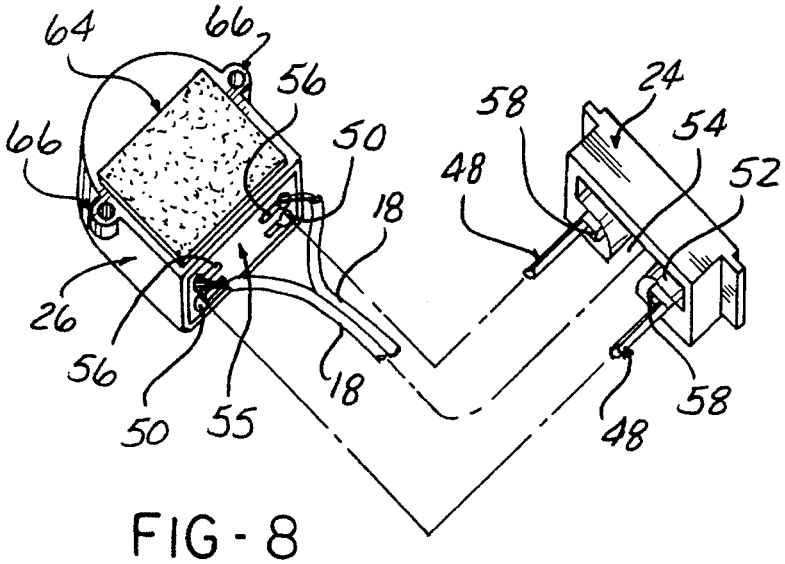
FIG. 8 is an exploded perspective view of the first embodiment of an auxiliary socket cap and auxiliary socket.
Figure 8A:
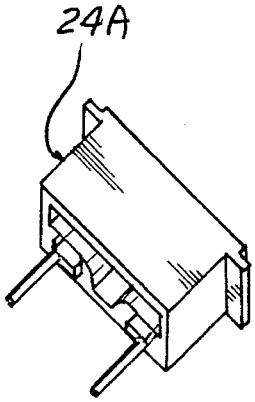
FIG. 8A is a perspective view of an auxiliary cap according to the embodiment shown in FIG. 8 of a different dimension.

FIG. 8 illustrates the details of the auxiliary socket cap 24, which is adapted to be assembled to the auxiliary socket 26, by means of nonconductive molded pins 48 projecting downwardly and spaced such as to be aligned with the lower contact openings 50 included in such sockets. The cap 24 is provided with an internal hollow 52, which receives the ends of the wire leads 18, which enter through a front slot 54 and which each have their stripped end inserted in the upper openings 56 of the auxiliary socket top, to be received in the internal retention spring contacts (not shown).

The pins 48 have elongated, raised protuberances 58, which are configured to be received in the slotted portion adjacent to the lead openings 50, such as to locate the cap 24 endwise on the auxiliary socket 26 when the pins 48 are inserted in the openings 50.

Figure 8B:
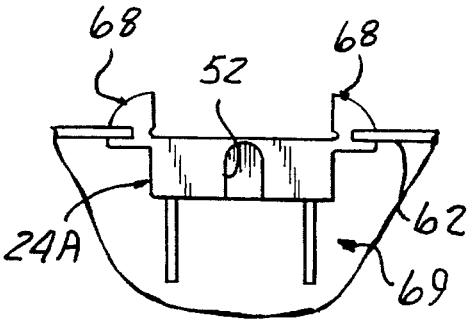
FIG. 8B is an end view of an installed auxiliary socket and cap shown installed in a light fixture housing.

The cap 24 includes a rectangular raised area 60, which may be received in a slot knock out in the upper wall 62 of the fixture housing 28 as shown in FIG. 8B.

The presence of the cap 24 insures the proper spaced location of the auxiliary socket 26 beneath the wall 62, such as to insure sufficient clearance for insertion of oversized tubes. The auxiliary socket 26 may be mounted, once in the proper location by means of double backed adhesive tape patch 64, as shown in FIG. 8, adhered to the back face thereof. Screws may also be employed, passing through the ears 66 and into the end wall 69 of the fixture housing 28.

As shown in FIG. 8B, the cap 24A may be provided with slotted flexible ears 68, which may be snap fit to the fixture wall 62 to mount both the auxiliary socket and the cap 24 to the fixture housing.

Figure 8C:
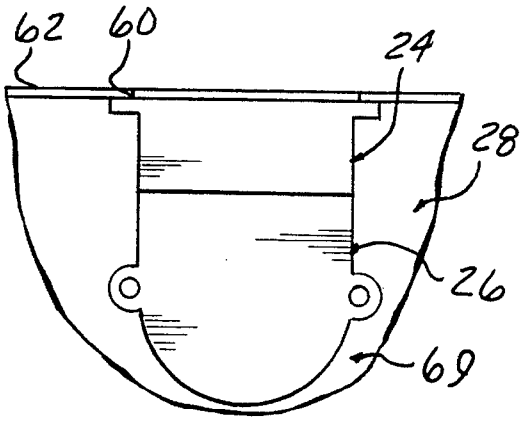
FIG. 8C is an side elevational view of a cap shown snap fit into an light fixture housing opening as an alternative to the installation shown in FIG. 8B.

FIG. 8C shows an alternate construction of the cap 24A, which is dimensioned with a higher height, in order to properly locate the particular auxiliary socket 26 the correct distance downwardly from the upper fixture housing wall 62.

Figure 9:
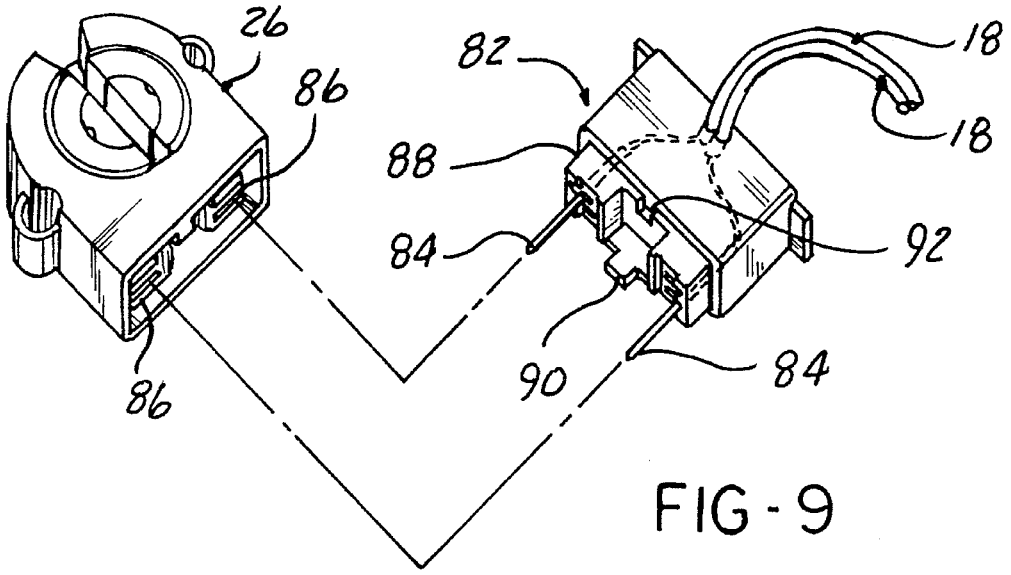
FIG. 9 shows a second embodiment of the auxiliary socket cap according to the present invention and auxiliary socket in an exploded relationship.

FIG. 9 shows a different configuration of cap 82, in which the wire leads 18 are molded within the cap 82. In this instance, the projecting pins 84 are electrically connected to conductors of the leads 18 and all of the same being molded integrally with then the body of the cap 82. The top 55 of the auxiliary socket 26 is removed in using the cap 82 and the conductive pins 84 are directly inserted into the connectors spring contact sockets 86, located within the spring housing 26. The cap 82 includes a reduced dimensioned plug portion 88, which replaces the top 55, with suitable locating projections 90 and 92 provided thus the contacts 84 provide both a mounting means, as well as an electrical connection.

Figure 10:
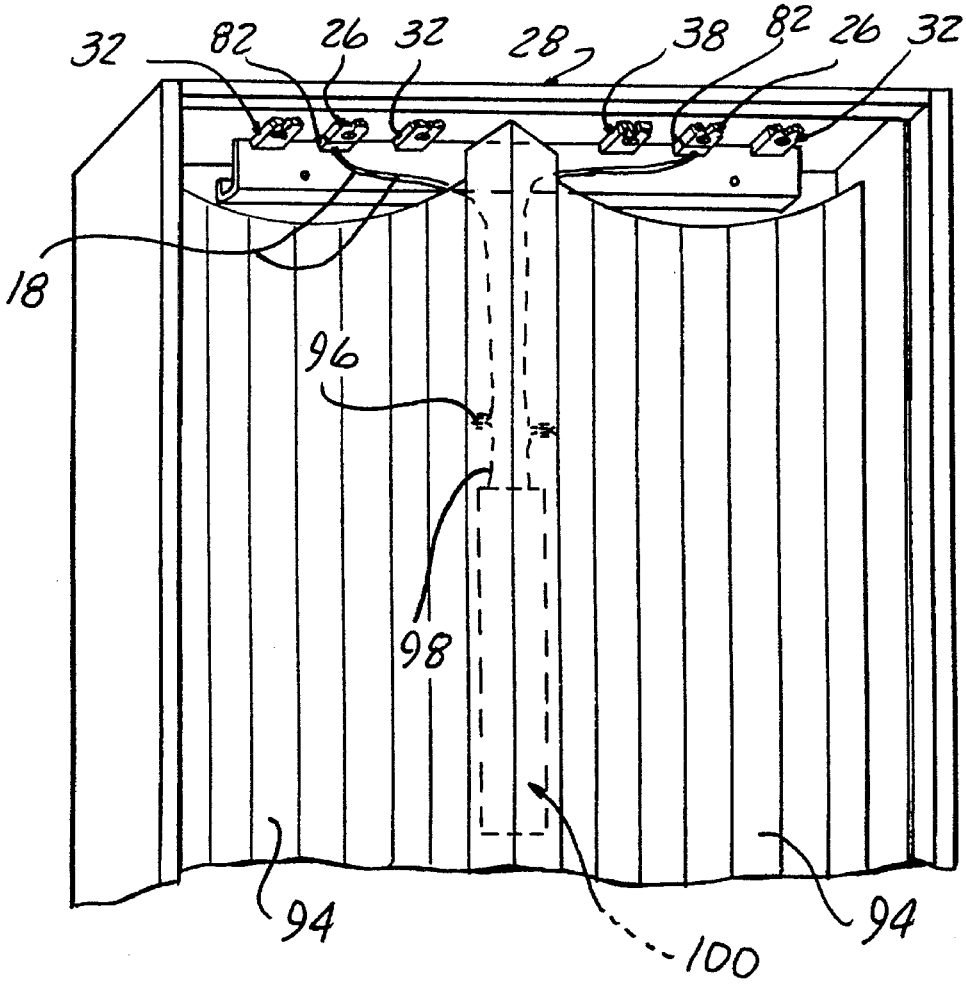
FIG. 10 is a fragmentary perspective view of a light fixture showing the auxiliary socket and cap installed therein, with the wire leads connected to an ballast.

The adapter 10 described above may also be eliminated as shown in FIG. 10, in which the fixture housing 28 is shown in fragmentary form. The auxiliary socket 26 and cap 82 are mounted centered between the original sockets 32. The wire leads 18 in this may be extended beneath the reflectors 94 provided in many retrofit applications, and secured as with wire nuts or other wire connectors 96 to the leads 98, extending from a retrofit electronic ballast 100, mounted beneath the reflectors 94. The use of the heavy duty wiring, i.e., SPT-1 or SPT-2 stranded two conductor 18 gauge, 105° C. rated wire allows the limited exposure within the fixture housing 28 of the leads 18. The use of the heavy gauge wire leads 18 is in turn allowed by the inclusion of the cap 82.

We claim:

1. An adapter for installation in a fluorescent tube socket having a pair of spring contacts to establish an electrical connection between each electrical spring contact provided in said socket for contact pins of said tube with respective one of a pair wire leads, said adapter including:

a generally cylindrical adapter body, a pair of parallel radially spaced apart conductive contact pins extending axially from said adapter body, each contact pin electrically connected with a respective one of said pair of wire leads;

a central locking pin axially projecting from said adapter body between said contact pins, extending from said adapter body into and engaging said socket to secure said socket and adapter together.

2. The adapter according to claim 1 further including engagement means acting upon rotation of said adapter to bring said contact pins into engagement with said socket spring contacts, said engagement means causing said locking pin to be forced into engagement with said socket to generate a retention friction force resisting withdrawal of said contact pins of said adapter.

3. The adapter according to claim 2 wherein said socket is formed with a pair of nonconducting pin guides spaced apart to form a central slot, said central locking pin disposed within said slot with said pin contacts inserted into said socket, said locking pin having of a narrower width in one dimension than the width of said slot but wider than said slot in another dimension, said locking pin wedging in said slot as said adapter body is rotated to bring said contact pins into contact with said socket spring contacts, said wedging comprising said retention force of said engagement means.

4. The adapter according to claim 3 wherein said locking pin has circumferentially grooved surface along the length thereof.

5. The adapter according to claim 2 wherein said locking pin is movably mounted in a radial direction transversely to a line passing through said contact pins, and spring urged to a centered location between said contact springs.

6. The adapter according to claim 1 wherein said locking pin is nonconductive, molded integrally with said adapter body.

7. The adapter according to claim 3 wherein said central locking pin is comprised of two halves separated by a slot, said halves squeezed together between said pin guides as said adapter is rotated to be installed.

8. The adapter according to claim 7 wherein each of said central pin halves is formed with a flat surface moving against a respective pin guide as said adapter is rotated to an installed position.

9. The adapter according to claim 7 further including a latching tab molded into said adapter body to normally project outwardly between said central pin halves, said tab resilient to be able to be flattened against said socket as said adapter body is pushed thereagainst during installation, said tab springing out between said contact pin guides as said adapter is rotated to said installed position.

10. The adapter according to claim 1 wherein said adapter body is provided with external markings aligned with a line connecting said contact pins.

11. The adapter according to claim 1 wherein said central locking pin passes through a bore in said adapter body and has a projecting portion which wedges between a pair of pin guides included in said socket when advanced through said bore in said adapter body.

12. A cap for a fluorescent tube auxiliary socket of a type having a pair of socket wire terminals for receiving a respective one of a pair of wire leads, said cap comprising a cap body and a pair of axially projecting pins spaced apart so as to mate with said auxiliary socket terminals, said cap overlying a top surface of said auxiliary socket and enclosing the end of said pair of wire leads extending out of said auxiliary socket.

13. The cap according to claim 12 wherein said auxiliary socket has a top covering said contacts with two pairs of openings therein, and wherein said wire leads are inserted through one pair of said openings to be received in said terminals, and wherein said cap pins are nonconductive and are inserted in the other pair of said openings.

14. The cap according to claim 13 wherein elongated protrusions extend from a base of each cap pin configured to be received in slots extending away from each opening.

15. The cap according to claim 13 wherein said cap is hollowed out and has a slot formed therein into which said wire leads pass in extending to said top openings.

16. The cap according to claim 12 wherein said wire leads are molded into said cap.

17. The cap according to claim 16 wherein said cap pins are conductive and each electrically connected to a wire lead, each of said pins received in an auxiliary socket wire terminal.

18. The cap according to claim 17 wherein said cap is formed with a protruding plug portion fitted into a recess in said auxiliary socket top.

19. The cap according to claim 12 wherein said cap is formed with a protruding rectangular plug portion adapted to be received in complementary opening in a light fixture housing.

20. The cap according to claim 19 wherein said protruding rectangular plug portion includes a slotted protrusion on opposite sides of said portion adapted to be snap fitted into said light fixture housing.

21. In combination, an adapter and a fluorescent tube socket having a pair of spring contacts, said adapter including:

a generally cylindrical adapter body;

a pair of parallel radially spaced apart pins extending axially from said adapter body;

a central locking pin axially projecting from said adapter body between said contact pins, extending from said adapter body into and engaging said socket to secure said socket and adapter together.

* * * * *